US011718116B2

(12) United States Patent
Yamada et al.

(10) Patent No.: US 11,718,116 B2
(45) Date of Patent: Aug. 8, 2023

(54) METHOD FOR MANUFACTURING CYLINDRICAL CONTAINER, AND CYLINDRICAL CONTAINER

(71) Applicants: TOYO SEIKAN CO., LTD., Tokyo (JP); TOYO SEIHAN CO., LTD., Kanagawa (JP)

(72) Inventors: Kouji Yamada, Kanagawa (JP); Zen Kanayama, Kanagawa (JP); Kenichirou Yamamoto, Kanagawa (JP); Kazuhiro Okamura, Tokyo (JP)

(73) Assignees: TOYO SEIKAN CO., LTD., Tokyo (JP); TOYO SEIHAN CO., LTD., Kanagawa (JP)

( * ) Notice: Subject to any disclaimer, the term of this patent is extended or adjusted under 35 U.S.C. 154(b) by 0 days.

(21) Appl. No.: 17/279,671

(22) PCT Filed: Sep. 25, 2019

(86) PCT No.: PCT/JP2019/037474
§ 371 (c)(1),
(2) Date: Mar. 25, 2021

(87) PCT Pub. No.: WO2020/067099
PCT Pub. Date: Apr. 2, 2020

(65) Prior Publication Data

US 2022/0032670 A1 Feb. 3, 2022

(30) Foreign Application Priority Data

Sep. 26, 2018 (JP) ..... 2018-180797

(51) Int. Cl.
*B41M 3/14* (2006.01)
*B41F 17/22* (2006.01)
(Continued)

(52) U.S. Cl.
CPC ..... *B41M 3/14* (2013.01); *B41F 17/22* (2013.01); *B41M 1/28* (2013.01); *B65D 7/04* (2013.01); *B65D 2203/06* (2013.01)

(58) Field of Classification Search
CPC ..... B65D 2203/06; B65D 7/04; B41M 1/27; B41M 3/14; B41F 17/22
See application file for complete search history.

(56) References Cited

U.S. PATENT DOCUMENTS

2005/0218026 A1* 10/2005 Gold ..... B65D 23/08 206/217
2007/0164559 A1* 7/2007 Kozdras ..... B41M 5/52 283/100

(Continued)

FOREIGN PATENT DOCUMENTS

JP 2002-160345 A 6/2002
JP 2006-248600 A 9/2006

(Continued)

OTHER PUBLICATIONS

Written Opinion of the International Searching Authority issued in International Application No. PCT/JP2019/037474, dated Dec. 3, 2019.

(Continued)

*Primary Examiner* — David H Banh
(74) *Attorney, Agent, or Firm* — Greenblum & Bernstein, P.L.C.

(57) ABSTRACT

Easy reading of a read code is enabled without matching a read range with a specific print section, and without impairing designability of a cylindrical container and clarity of a display print.

A cylindrical container has, on the outer surface thereof, a print layer. The print layer has an electronic watermark layer including an electronic watermark image printed thereon, and a blindfold layer that renders the electronic watermark (Continued)

image difficult to be visually recognized. The print area of the blindfold layer matches a part or entirety of the print area of the electronic watermark layer.

12 Claims, 5 Drawing Sheets

(51) Int. Cl.
*B41M 1/28* (2006.01)
*B65D 8/00* (2006.01)

(56) References Cited

U.S. PATENT DOCUMENTS

2013/0176358 A1* 7/2013 Yamada ..... B41J 3/4073 347/20
2013/0258477 A1* 10/2013 Lok ..... G02B 27/4233 359/573
2013/0336525 A1 12/2013 Kurtz et al.
2015/0192897 A1* 7/2015 Schilling ..... G02B 5/285 359/2
2015/0258837 A1* 9/2015 Ritter ..... B42D 25/355 283/67
2015/0290923 A1* 10/2015 Treloar ..... B41F 9/01 101/217
2016/0225293 A1* 8/2016 Basset ..... G09F 3/0376
2016/0303879 A1* 10/2016 Yamada ..... B41M 3/008
2017/0061563 A1 3/2017 Falkenstern et al.
2018/0264804 A1 9/2018 Chishiki et al.

FOREIGN PATENT DOCUMENTS

JP 2008-044662 A 2/2008
JP 2009-234656 A 10/2009
JP 2014-104637 A 6/2014
WO 2017/221596 A1 12/2017

OTHER PUBLICATIONS

International Search Report issued in International Patent Application No. PCT/JP2019/037474, dated Dec. 3, 2019, along with an English translation thereof.
Extended European Search Report for corresponding European Patent Application No. 19864958.4 dated Jul. 14, 2022.
Notice of Reasons for Refusal for corresponding Japanese Patent Application No. 2018-180797 dated Oct. 4, 2022, along with English translation thereof.
Office Action Issued in Corresponding JP Patent Application No. 2018-180797, dated Mar. 7, 2023, along with an English translation thereof.

* cited by examiner

METHOD FOR MANUFACTURING CYLINDRICAL CONTAINER, AND CYLINDRICAL CONTAINER

TECHNICAL FIELD

The present invention relates to a cylindrical container manufacturing method and a cylindrical container.

BACKGROUND ART

A container having a character, a pattern, or the like printed on an outer surface thereof is generally known. The character, the pattern, or the like printed on such a container generally includes a read code such as a bar code or a two-dimensional code. The read code printed on the container is read by a reading device such as a camera or a scanner, whereby various information can be associated with containers individually (see the following PTL 1).

CITATION LIST

Patent Literature

[PTL 1] Japanese Patent Application Publication No. 2006-248600

SUMMARY OF INVENTION

Technical Problem

For reading a read code printed on a container, it is necessary to match a read range to a site where a bar code or a two-dimensional code is printed. For this reason, at production sites or distribution management sites of containers, it becomes necessary to align the orientations of containers to a certain direction relative to the orientation of a set reading device, and this requires a complicated alignment operation of the containers. Further, when a consumer reads a bar code or a two-dimensional code by the camera function of a portable terminal, a problem of difficulty in finding out the print section of a bar code or a two-dimensional code arises.

In order to address such a problem, it can be considered that read codes are printed on a plurality of sites on the outer surface of the container, or a read code is printed over a relatively larger area. However, this impairs the designability of the container, and makes the print of, for example, a trade name, which is to be displayed, difficult to be identified.

An object of the present invention is to address such an issue. Namely, an object of the present invention is to enable easier reading of a read code without requiring matching a reading range to a specific print section, or without impairing designability of a container and clarity of a display print, and the like.

Solution to Problem

In order to solve such problems, the present invention has the following features.

A manufacturing method for a cylindrical container having a print layer formed on an outer surface thereof, the method including: with a plurality of plates having a line drawing part to be printed on the outer surface of the cylindrical container being provided, a step of allowing an ink to individually adhere to the plates, and transferring the ink, adhered to the plates, to an intermediate transfer body for each of the plates; and a step of transferring the ink, transferred to the intermediate transfer body, to the outer surface of the cylindrical container, wherein among the plates, at least one plate is a plate having a line drawing part of an electronic watermark image, and another plate is a plate having a line drawing part that renders the electronic watermark image difficult to be visually recognized, and a print area of the line drawing part that renders the electronic watermark image difficult to be visually recognized is matched with a part or entire print area of the electronic watermark image.

A cylindrical container having a print layer on an outer surface thereof, wherein the print layer has a layer including the electronic watermark image printed thereon, and a blindfold layer that renders the electronic watermark image difficult to be visually recognized, and a print area of the blindfold layer matches a part or entirety of a print area of the electronic watermark image.

Advantageous Effects of Invention

The present invention has the foregoing features, and hence enables an electronic watermark image to be printed on the outer surface of a cylindrical container, and can render the printed electronic watermark image difficult to be visually recognized. As a result, it is possible to read the read code from the electronic watermark image with ease without matching the reading range to a specific print section. Further, in the print area of the electronic watermark image, a blindfold layer for rendering this difficult to be visually recognized is printed. For this reason, it becomes possible to read the read code from the electronic watermark image with ease without impairing the designability of the cylindrical container and the clarity of the display print.

BRIEF DESCRIPTION OF DRAWINGS

FIG. 1(*b*) is an explanatory view (a back view) showing one example of a cylindrical container in accordance with an embodiment of the present invention.

FIG. 4(*b*) is an explanatory view showing a plate (a plate for a second color) in the printer.

FIG. 4(*c*) is an explanatory view showing a plate (a plate for a third color) in the printer.

FIG. 4(*d*) is an explanatory view showing a plate (a plate for a fourth color) in the printer.

FIG. 5(*b*) is an explanatory view showing a plate (a plate having a line drawing part of a blindfold layer) in a printer.

DESCRIPTION OF EMBODIMENTS

Below, embodiments of the present invention will be described with reference to the accompanying drawings. In the following description, a description will be given by taking a can container as one of the cylindrical containers as an example. However, the cylindrical container in accordance with the embodiment of the present invention is not limited to a can container. Further, in the following embodiments, for the example of a can container, a description is given by taking a seamless can as an example. However, the can container may be a welded can, or the like. The cylindrical container in accordance with the embodiment of the present invention has no particular restriction on the material for the container, and, for example, a metal, plastic, glass, paper, and the like are also acceptable.

Any shape of the cylindrical container is acceptable so long as a part thereof has a cylindrical shape. The overall shape of the container may be a bottle shape, a tube shape, or the like other than the cylindrical shape. Further, the ones in a cylindrical shape as the in-between shape, and shaped to have other shapes in the final shaping step are also included in the cylindrical containers in the present invention.

Figure 1A:
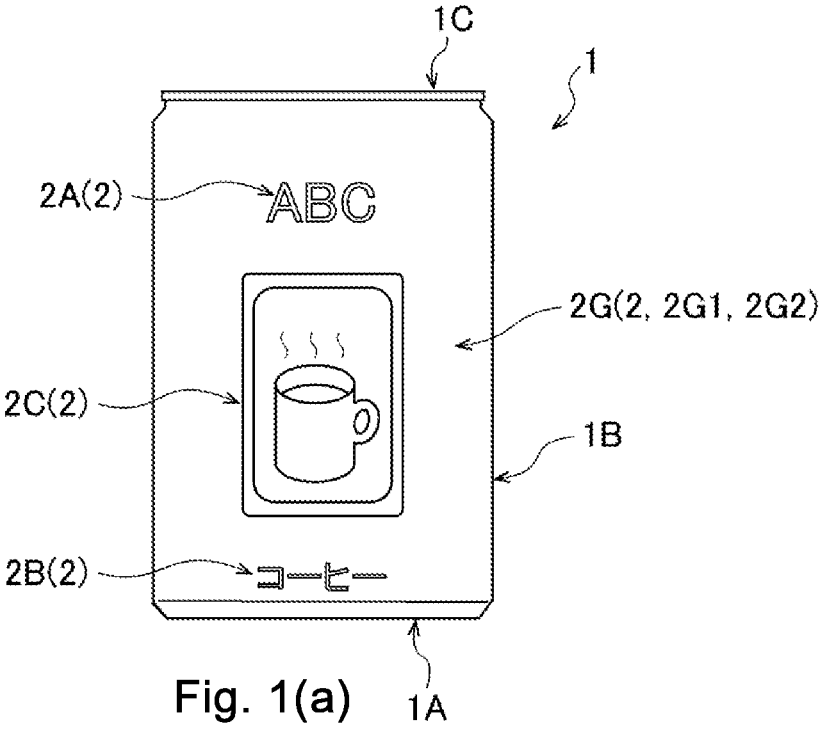
FIG. 1(*a*) is an explanatory view (a front view) showing one example of a cylindrical container in accordance with an embodiment of the present invention.
Figure 1B:
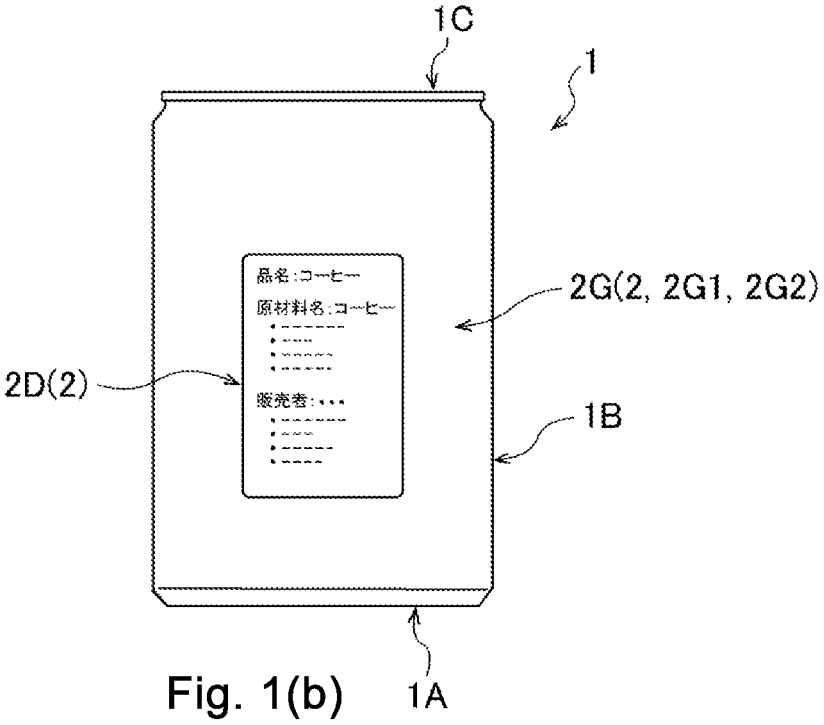

As shown in FIG. 1, the can container is obtained by forming a print layer 2 on the outer surface of a can body 1 including a bottom part 1A, a drum part 1B, a can lid 1C, and the like. The can body 1 is a seamless can. The bottom part 1A and the drum part 1B are integrally formed by drawing/ironing processing from one sheet material. For the shown example, the can lid 1C is seamed to, and is connected to the top of the drum part 1B. The can body 1 shown is one example, and the shape of the can body 1 is not limited to the shown example.

The print layer 2 of the can body 1 has a display area including character print parts 2A, 2B, and 2D, a pattern print part 2C, and the like, and a negative space 2G excluding the display area such as the character print parts 2A, 2B, and 2D, and the pattern print part 2C. Then, in the negative space 2G, a layer including an electronic watermark image printed therein (electronic watermark layer) 2G1, and a layer that renders the electronic watermark image difficult to be visually recognized (blindfold layer) 2G2 are printed. Herein, the blindfold layer 2G2 may be a layer formed on the electronic watermark layer 2G1, or a layer formed under the electronic watermark layer 2G1.

Further, the blindfold layer 2G2 may be formed in the entire area of the electronic watermark layer 2G1, or may be formed in a part thereof. Further, the blindfold layer 2G2 may be formed over and beyond the area of the electronic watermark layer 2G1. Further, herein, the electronic watermark image is printed in areas (negative space) other than the display area of a character, a pattern, and the like. In the color, the pattern, and the character used in a wide range in a plan view of the can front, an electronic watermark image may be placed. For example, in the case of the design such that a marking is repeatedly arranged along the entire circumference of the container, an electronic watermark image is placed at the repeated marking part. This enables reading of the read code from anywhere.

The electronic watermark image includes, for example, watermark information including a read code embedded therein by undergoing two-dimensional pattern modulation, and is read by a reading device, thereby enabling acquisition of electronic data including various information.

Figure 2:
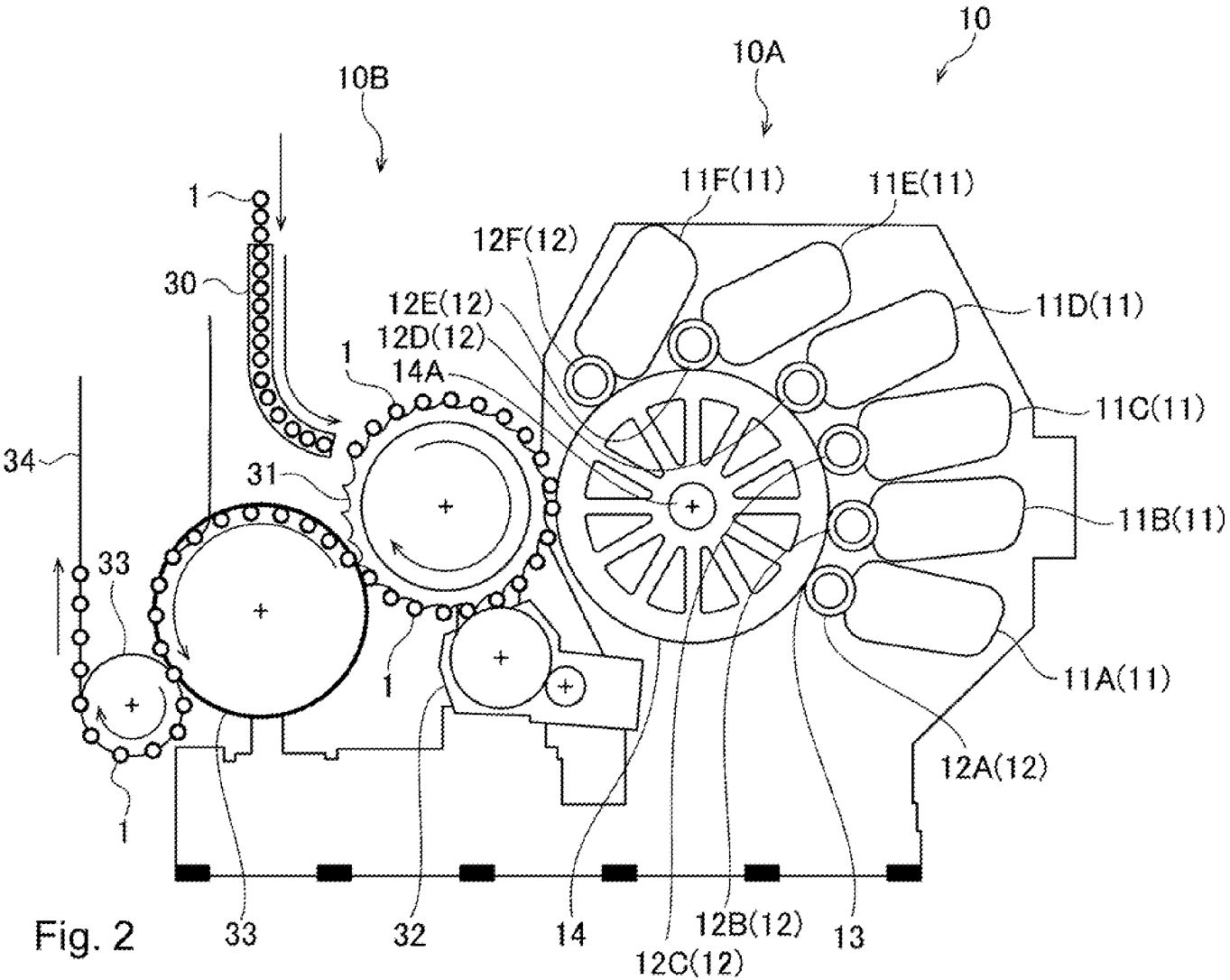
FIG. 2 is an explanatory view (an overall view) showing a printer for forming a print layer of the cylindrical container in accordance with an embodiment of the present invention.

The print layer 2 in the can body 1 is formed by a printer (offset printer) 10 shown in FIG. 2. The printer 10 has, as the main configuration, a print layer forming part 10A, and a can body supply discharge part 10B for supplying the can body 1 before print layer formation to the print layer forming part 10A, and discharging the can body 1 after print layer formation.

The print layer forming part 10A has ink stations 11 (11A, 11B, 11C, 11D, 11E, and 11F) for supplying an ink, plate cylinders 12 (12A, 12B, 12C, 12D, 12E, and 12F) each for supporting a plate, and a blanket drum 14 for supporting a blanket 13 of an intermediate transfer body. The ink stations 11 (11A to 11F) include a mechanism (such as an inker roller) for supplying the stored ink to the plate supported by the plate cylinder 12, and are arranged in a plurality of number for each plate around the blanket drum 14. The plurality of ink stations 11 (11A to 11F) may respectively supply inks of different colors, and some of them may supply inks of the same color.

The blanket drum 14 rotates around the rotation shaft 14A, thereby bringing a plurality of blankets 13 supported therearound into contact with a plurality of plates supported by respective plate cylinders 12 (12A to 12F) one after another.

Figure 3:
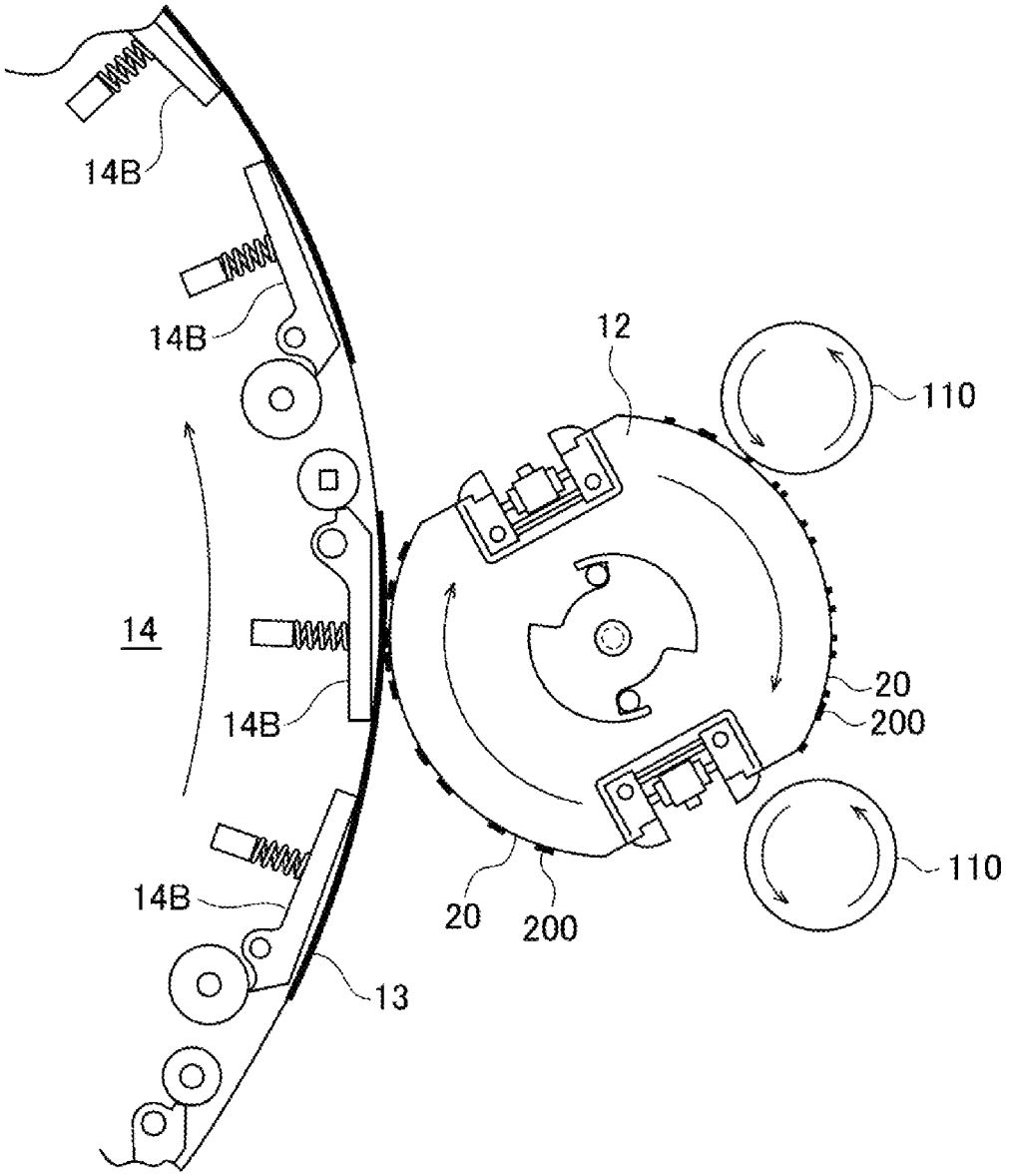
FIG. 3 is an explanatory view (a partial view) showing the printer for forming a print layer of the cylindrical container in accordance with an embodiment of the present invention.
Figure 4A:
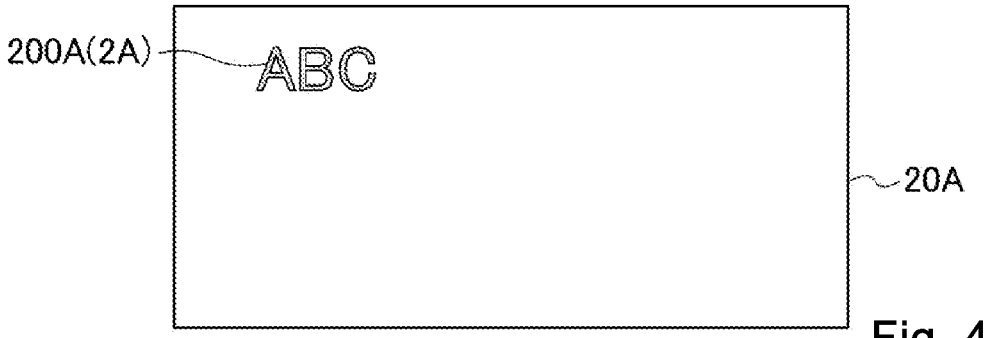
FIG. 4(*a*) is an explanatory view showing a plate (a plate for a first color) in the printer.
Figure 4B:
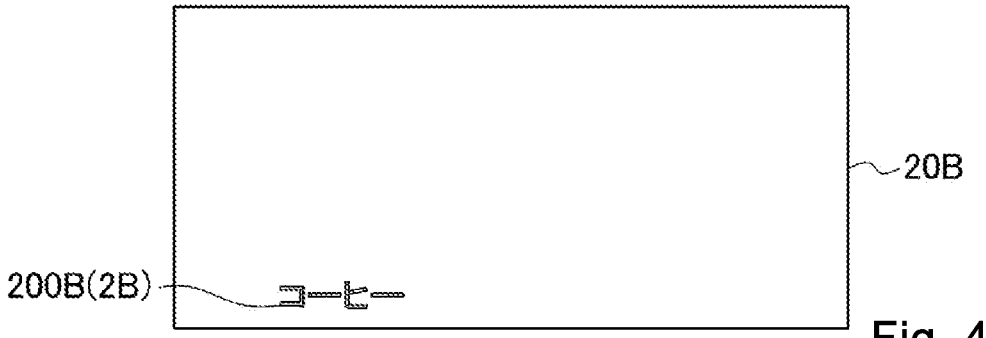
Figure 4C:
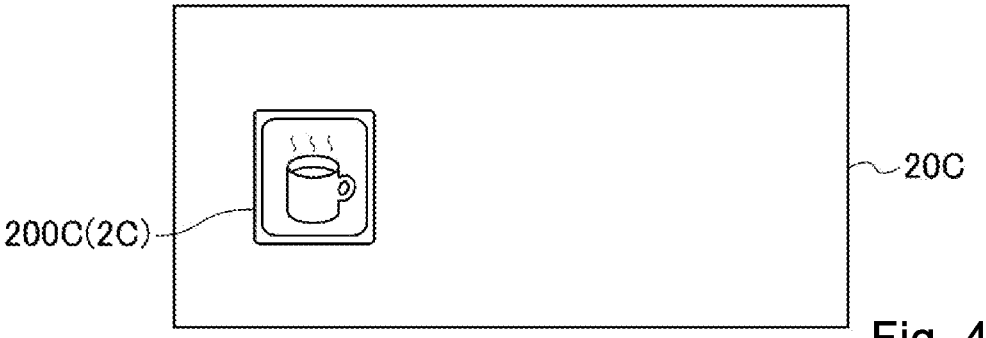
Figure 4D:
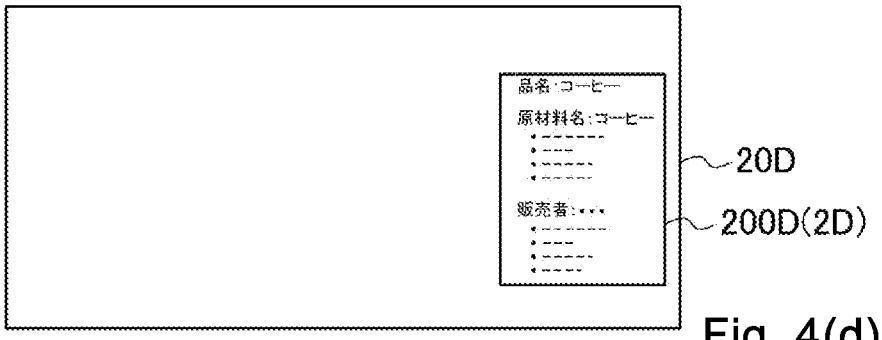

As shown in FIG. 3, the plate 20 supported by the plate cylinder 12 comes in contact with the ink supply mechanism (foam roller 110) in the ink station 11. Accordingly, an ink adheres to the line drawing part (convex part) 200 of the plate 20. The plate 20 to which the ink has adhered comes in contact with the surface of the blanket 13 supported on the support part 14B of the blanket drum 14 by the rotation of the plate cylinder 12 and the blanket drum 14. As a result, the ink adhered to the line drawing part 200 of the plate 20 is transferred to the blanket 13 of an intermediate transfer body.

The can body supply discharge part 10B includes a can shooter 30 for getting the can bodies 1 therein, and a mandrel turret 31 for holding the can bodies 1 supplied from the can shooter 30, and successively rotationally moving the can bodies 1 in the direction of the print layer forming part 10A. Further, a varnish coating part 32 for applying a transparent over varnish on the surface of each can body 1 to which the print layer has been transferred is attached to the mandrel turret 31. Each can body 1 coated with the over varnish is guided to the discharge path 34 through a transfer turret 33.

The formation step of the print layer by such a printer 10 will be described. The plate cylinders 12A, 12B, 12C, and 12D in the printer 10 each support a plate having a line drawing part corresponding to the character, the pattern, and the like to be printed on the outer surface of the can body. Respective plates are provided corresponding to the ink stations 11A, 11B, 11C, and 11D. This causes an ink to adhere to the plates supported by respective plate cylinders 12A to 12D. The ink adhered to each plate is transferred to the blanket 13 of an intermediate transfer body for every plate.

In contrast, the plate cylinder 12F supports a plate having a line drawing part of an electronic watermark image. The line drawing part of the electronic watermark image is formed in the area other than the line drawing part of the plate having the line drawing part of, for example, the character or the pattern (negative space). The plate of the plate cylinder 12F is provided corresponding to the ink station 11F. The ink supplied by the ink station 11F adheres to the line drawing part of the electronic watermark image. The adhered ink is transferred to the blanket 13 of an intermediate transfer body.

Further, the plate cylinder 12E supports the plate having the line drawing part that renders the electronic watermark image difficult to be visually recognized. The plate is provided corresponding to the ink station 11E. The ink supplied by the ink station 11E adheres to the line drawing part that renders the electronic watermark image difficult to be visually recognized. The adhered ink is transferred to the blanket 13 of an intermediate transfer body.

Then, all the inks transferred to one blanket 13 are transferred in accordance with the rotation of the blanket drum 14 and the mandrel turret 31 having the can bodies 1 held thereon from the blanket 13 to the outer surface of each can body 1. As a result, the print layer 2 is formed on the can body 1. Subsequently, each can body 1 having the print layer 2 formed thereon is moved by the rotation of the mandrel turret 31. The varnish coating part 32 attached to the mandrel turret 31 applies an over varnish onto the print layer 2. For the can body 1 thus undergoing printing, reading of the electronic watermark information was possible by the camera of a portable terminal.

Incidentally, in the foregoing description, the arrangement of the ink stations 11 (11A to 11F) (or, the plate cylinders 12 (12A to 12F) corresponding thereto) is not limited to the shown example, and they may be arranged in any order. Further, the plates of the line drawing parts of the electronic watermark image and the line drawing parts that renders the electronic watermark image difficult to be visually recognized may be provided in plurality, respectively. In that case, the ink stations and the plate cylinders corresponding to the plates are set. Also for the plate having the line drawing part corresponding to the character, the pattern, and the like, in the previous description, the number of the plates was four, but is not limited to the number. Further, when the line drawing part of the electronic watermark image and the line drawing part of a character, a pattern, and the like have the ink in the same color, the line drawing part of the electronic watermark image and the line drawing part of a character, a pattern, or the like may be provided at one plate.

Figure 5A:
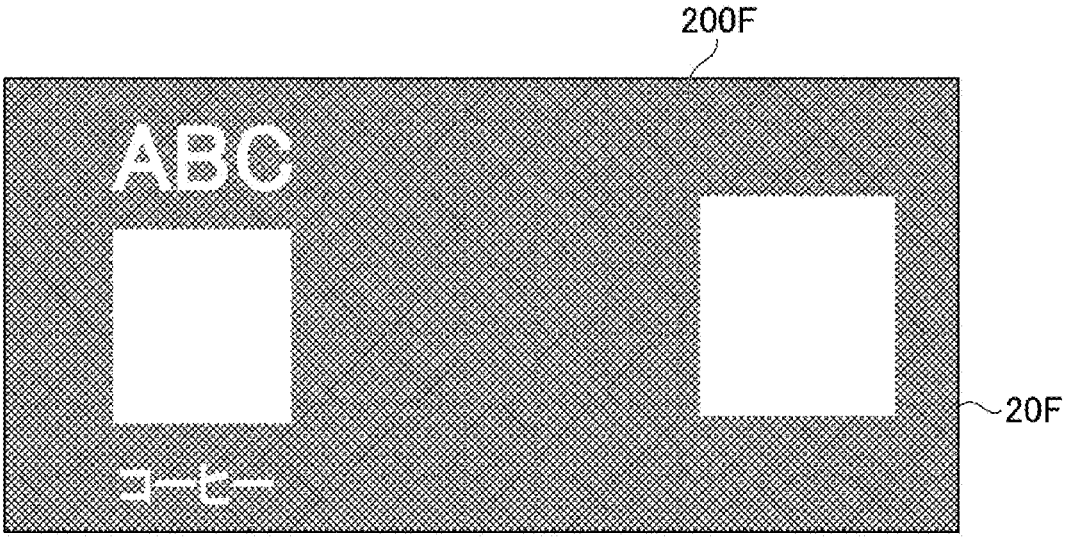
FIG. 5(*a*) is an explanatory view showing a plate (a plate having a line drawing part of an electronic watermark image) in a printer.
Figure 5B:
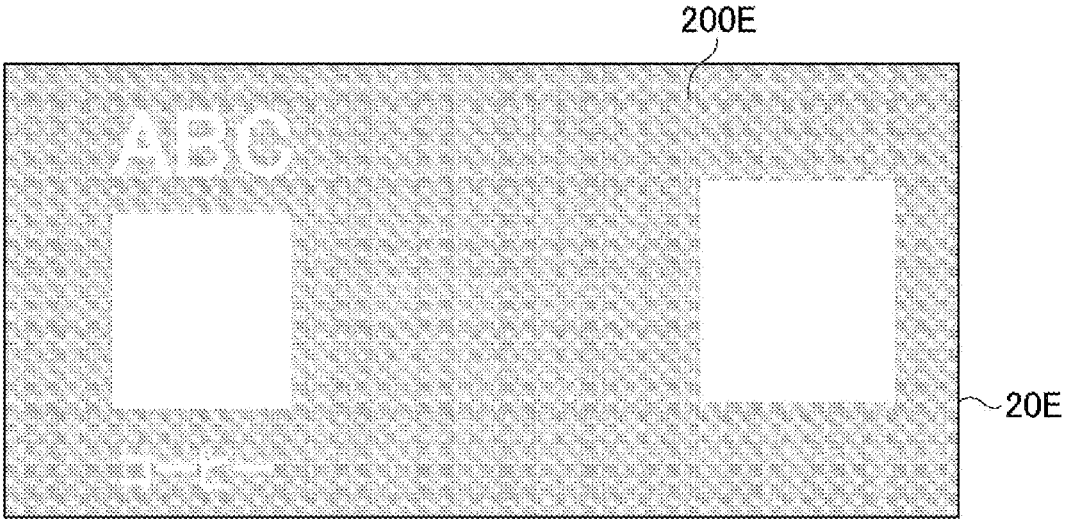

FIGS. 4 and 5 show the line drawing parts of respective plates supported by the plate cylinders 12 (12A to 12F). FIG. 4 shows the plates supported by the plate cylinders 12A to 12D, where FIG. 4(*a*) shows, for example, a plate 20A of a first color. Herein, the plate 20A has a line drawing part 200A of the character print part 2A. FIG. 4(*b*) shows, for example, a plate 20B of a second color. Herein, the plate 20B has the line drawing part 200B of the character print part 2B. FIG. 4(*c*) shows, for example, a plate 20C of a third color. Herein, the plate 20C has the line drawing part 200C of the pattern print part 2C. FIG. 4(*d*) shows a plate 20D of a fourth color. Herein, the plate 20D has the line drawing part 200D of the character print part 2D.

FIG. 5 shows the line drawing parts of respective plates supported by the plate cylinders 12E and 12F. FIG. 5(*a*) shows the plate 20F supported by the plate cylinder 12F. The plate 20F has the line drawing part 200F of the electronic watermark image. The line drawing part 200F of the electronic watermark image is formed in the common area except for the line drawing part corresponding to the plates 20A to 20D shown in FIGS. 4(*a*) to 4(*d*). Herein, the line drawing part 200F of the electronic watermark image may be formed in the entire area except for the line drawing parts corresponding to the plates 20A to 20D, or may be formed in a part thereof. As the effects thereof, the line drawing part 200E of the electronic watermark image does not overlap the area of the line drawing parts in the plates 20A to 20D. This prevents the reduction of the clarity of display, the design, or the like of the line drawing parts in the plates 20A to 20D.

On the other hand, the line drawing part 200E of the electronic watermark image may be formed in a part or the whole of, or further over and beyond the area of line drawing part in the plates 20A to 20D. The reason for this is as follows. Also in the print area showing a character or a pattern such as line drawing part in the plates 20A to 20D, the electronic watermark image is printed in an overlapping manner, or thereunder, so that the figure of the electronic watermark image may be good as a design. For example, the figure of the electronic watermark image can be used as a marking such as a grid of dots or a mosaic as the design. For this reason, an electronic watermark image can be placed as a character or the marking of the pattern itself. For the same reason, the following configuration is also acceptable. An electronic watermark image is placed in a partial or the whole area of the plates 20A to 20D, and the electronic watermark image is connected to the electronic watermark image placed in the surrounding negative space.

Up to this point, in any case, the effects of the present invention of allowing easy reading of a read code from the electronic watermark image without matching the reading range of the electronic watermark to a specific print section, and preventing the reduction of the designability and the clarity of the display print of a can container can be exerted. Incidentally, the line drawing part 200E of the electronic watermark image may be displayed by expressing the electronic watermark figure (dots) in white, or coloring and expressing the figure portion (dots).

FIG. 5(*b*) shows the plate 20E supported by the plate cylinder 12E. The plate 20E has the line drawing part 200E that renders the electronic watermark image difficult to be visually recognized. Similarly to the line drawing part 200F, the line drawing part 200E that renders the electronic watermark image difficult to be visually recognized is formed in the area except for the line drawing part common to the plates 20A to 20D shown in FIGS. 4(*a*) to 4(*d*). The line drawing part 200E that renders the electronic watermark image difficult to be visually recognized matches the print area of the line drawing part 200F, but is not necessarily required to totally match therewith, and may partially match therewith. The blindfold layer 2G2 is printed by the line drawing part 200E of the plate 20E.

With such a container or manufacturing method for a container, even when the print layer 2 printed on the outer surface of the container is a print layer including an electronic watermark image, it becomes possible to clearly display a display area including a character print parts 2A, 2B, and 2D, a pattern print part 2C, and the like.

Further, the electronic watermark layer 2G1 including a read code is formed in the negative space except for the display area. As a result, read codes can be dispersed in a wide range of the outer surface of the container. This enables reading of the read codes without matching the reading range to a specific print section. Further, the blindfold layer 2G2 is formed in the print area matching the electronic watermark layer 2G1. This can inhibit the display quality of the display area from being reduced by the electronic watermark image.

Incidentally, in the foregoing description, the case was shown where the horizontal cross section (the cross section of the container in a standing position) of the to-be-printed portion of the container (can container) is in a circular shape. By providing a shaping step of shaping into various shapes after the print step, it is possible to form the final shape of the container into various shapes such as an ellipse or a rectangle. As the shaping step, examples may be made of known expand shaping, bulge shaping, emboss shaping, necking shaping, or the like.

Incidentally, the method for performing offset printing on a container having a soft material such as plastic as the material of the container, and having a three-dimensional structure is shown in Japanese Patent Application Publication No. 2008-044662. This method can also be used.

REFERENCE SINGS LIST

1 Can body
2 Print layer
2A, 2B, 2D Character print part
2C Pattern print part
2G Negative space
2G1 Electronic watermark layer
2G2 Blindfold layer
10 Printer
20, 20A to 20F Plate
200, 200A to 200F Line drawing part

The invention claimed is:

1. A manufacturing method for a cylindrical container having a print layer formed on an outer surface thereof, the method comprising:

with a plurality of plates having a line drawing part to which ink adheres to be printed on the outer surface of the cylindrical container being provided, allowing an ink to individually adhere to the plates at the line drawing part of each plate, and transferring the ink, adhered to the plates, to an intermediate transfer body for each of the plates; and transferring the ink, transferred to the intermediate transfer body, to the outer surface of the cylindrical container, wherein among the plates, at least one plate is a plate having a line drawing part of an electronic watermark image, and another plate is a plate having a line drawing part that renders the electronic watermark image difficult to be visually recognized, and whereby a print area of the line drawing part that renders the electronic watermark image difficult to be visually recognized is matched with a part or entire print area of the electronic watermark image, and the matched print area of the line drawing part that renders the electronic watermark image difficult to be visually recognized is readable by a reading device.

2. The manufacturing method for the cylindrical container according to claim 1, wherein the line drawing part of the electronic watermark image and the line drawing part that renders the electronic watermark image difficult to be visually recognized are formed in an area except for a line drawing part corresponding to the other plate.

3. The manufacturing method for the cylindrical container according to claim 1, wherein the line drawing part of the electronic watermark image and the line drawing part that renders the electronic watermark image difficult to be visually recognized are formed in a partial or entire area of a line drawing part corresponding to the other plate.

4. The manufacturing method for the cylindrical container according to claim 2, wherein the line drawing part of the electronic watermark image is formed in a part or entirety of a negative space.

5. The manufacturing method for the cylindrical container according to claim 1, wherein the cylindrical container is a metallic can.

6. A cylindrical container having a print layer produced by the method of claim 1 on an outer surface thereof, wherein the print layer has an electronic watermark layer including the electronic watermark image printed thereon, and a blindfold layer that renders the electronic watermark image difficult to be visually recognized, and a print area of the blindfold layer matches a part or entirety of a print area of the electronic watermark layer, wherein the electronic watermark image in the matched print area of the blindfold layer is readable by the reading device.

7. The cylindrical container according to claim 6, wherein the print layer includes the electronic watermark layer, the blindfold layer, and an image layer other than the electronic watermark layer and the blindfold layer, and wherein a print area of the other image layer and a print area of the electronic watermark layer do not overlap each other.

8. The cylindrical container according to claim 6, wherein the print layer includes the electronic watermark layer, the blindfold layer, and an image layer other than the electronic watermark layer and the blindfold layer, and wherein a print area of the electronic watermark layer partially or entirely overlaps a print area of the other image layer.

9. The cylindrical container according to claim 7, wherein the electronic watermark image is printed in a negative space of an image to be printed in the cylindrical container.

10. The cylindrical container according to claim 6, wherein the cylindrical container is a metallic can.

11. The manufacturing method for the cylindrical container according to claim 3, wherein the line drawing part of the electronic watermark image is formed in a part or entirety of a negative space.

12. The cylindrical container according to claim 8, wherein the electronic watermark image is printed in a negative space of an image to be printed in the cylindrical container.

* * * * *